US009978346B2

(12) United States Patent
Oberg

(10) Patent No.: US 9,978,346 B2
(45) Date of Patent: May 22, 2018

(54) STRINGED MUSICAL INSTRUMENT FOR GENERATING SOUND FROM TWO SOUND BOARDS ON OPPOSITE SIDES OF THE INSTRUMENT AND A METHOD OF CONSTRUCTION

(71) Applicant: Robert L. Oberg, Syosset, NY (US)

(72) Inventor: Robert L. Oberg, Syosset, NY (US)

( * ) Notice: Subject to any disclaimer, the term of this patent is extended or adjusted under 35 U.S.C. 154(b) by 0 days. days.

(21) Appl. No.: 15/659,438

(22) Filed: Jul. 25, 2017

(65) Prior Publication Data

US 2018/0025705 A1 Jan. 25, 2018

Related U.S. Application Data

(60) Provisional application No. 62/366,346, filed on Jul. 25, 2016.

(51) Int. Cl.

| | |
|---|---|
| ***G10D 3/04*** | (2006.01) |
| ***G10D 1/08*** | (2006.01) |
| ***G10H 3/18*** | (2006.01) |
| ***G10D 3/02*** | (2006.01) |
| ***G10D 3/12*** | (2006.01) |

(52) U.S. Cl.

CPC ..... *G10D 1/08* (2013.01); *G10D 3/02* (2013.01); *G10D 3/04* (2013.01); *G10D 3/12* (2013.01); *G10H 3/18* (2013.01)

(58) Field of Classification Search

CPC G10D 3/04; G10D 9/00; G10H 3/185; G10H 2220/501; G10H 2220/465; G01H 11/02; G01H 9/00

See application file for complete search history.

(56) References Cited

U.S. PATENT DOCUMENTS

| | | | | |
|---|---|---|---|---|
| 5,078,041 | A * | 1/1992 | Schmued | G10H 3/185 84/731 |
| 8,381,377 | B1 * | 2/2013 | Poliak | G10D 3/12 28/298 |
| 2009/0173208 | A1 * | 7/2009 | Tamura | G10D 3/12 84/302 |
| 2013/0074674 | A1 * | 3/2013 | Musel | G10D 3/02 84/313 |
| 2014/0083275 | A1 * | 3/2014 | Martin | G10D 3/12 84/307 |
| 2016/0163294 | A1 * | 6/2016 | Martin | G10D 1/08 84/267 |

* cited by examiner

*Primary Examiner* — Marlon Fletcher
(74) *Attorney, Agent, or Firm* — Scarinci & Hollenbeck

(57) ABSTRACT

A stringed musical instrument and method of constructing a stringed musical instrument, having a body with a hollow or semi-hollow interior, a front and rear sound board disposed on opposite sides of the hollow interior, a single set of strings and a dual bridge and saddle assembly extending between the front and rear sound board with the dual bridge and saddle assembly including a first bridge and saddle mounted upon the front sound board, a second bridge and saddle mounted upon the rear sound board and with said single set of strings being strung such that the single set of strings interconnect the first bridge and front sound board to the second bridge and rear sound board through the interior body of the musical instrument for generating sound from each sound board respectively.

23 Claims, 10 Drawing Sheets

STRINGED MUSICAL INSTRUMENT FOR GENERATING SOUND FROM TWO SOUND BOARDS ON OPPOSITE SIDES OF THE INSTRUMENT AND A METHOD OF CONSTRUCTION

FIELD OF THE INVENTION

The present invention is directed to a stringed musical instrument such as a guitar, violin or banjo having a hollow or semi-hollow body for producing and controlling sound from two separate sound boards disposed on opposite sides of the musical instrument using only a single set of strings interconnecting a bridge on each sound board through the hollow interior of the musical instrument and a method of constructing a stringed musical instrument having a hollow or semi-hollow body for producing and controlling sound from each of two sound boards disposed on opposite sides of the body of the musical instrument using a single set of strings interconnecting a bridge on each sound board through the hollow interior of the musical instrument.

BACKGROUND OF THE INVENTION

Conventional stringed musical instruments which have a hollow or semi-hollow body generate musical tones by strumming or plucking strings stretched over a bridge and saddle mounted on the sound board corresponding to the anatomical front of the musical instrument. Sound is produced by the vibration of the strings and transmitted from a bridge assembly, mounted upon the sound board, throughout the body of the musical instrument and exits through a sound hole in the musical instrument, generally located in the anatomical front sound board and usually underneath the strings.

In an acoustical guitar the hollow interior of the body forms an acoustical resonant enclosure which enhances and amplifies the sound generated from the sound board. The sound board of the musical instrument is conventionally understood to represent the top or front of the instrument. The rear or back of the guitar is not considered to have much, if any, significance relative to the overall sound generated by the musical instrument and, as such, little attention is given to the wood used in the construction of the rear board of the guitar. The front and rear boards are connected to the body of the instrument along the sides thereof to fully enclose the body surrounding the hollow interior. As explained above, the front board is recognized as the sound board of an acoustical guitar and is composed of expensive tone woods such as, for example, spruce and/or red cedar whereas the rear board is typically composed of inexpensive wood or other material. The front and rear boards of a conventional acoustical guitar usually includes ribs on the inner side of each board facing the interior of the guitar to add to the structural strength of each board respectively. However, in most cases, no structural support exists between the front and rear boards of a conventional acoustical guitar other than the support provided by the sides connecting the front to the rear board.

It has been discovered in accordance with the present invention that the sound produced from a stringed musical instrument can be enhanced by simultaneously utilizing both sound boards inclusive of both the front sound board and the rear sound board of the guitar for generating sound independent of one another utilizing a single set of guitar strings to interconnect the front sound board to the rear sound board through the interior of the guitar. This is accomplished in accordance with the present invention using a dual bridge and saddle assembly which includes a first bridge and saddle mounted on the front sound board of the musical instrument and a second bridge and saddle mounted on the rear sound board with a single set of guitar strings interconnecting the first bridge and the second bridge through the hollow interior of the guitar. The dual bridge and saddle assembly should preferably also include support posts connected between the first bridge and the second bridge through the interior of the guitar for providing additional structural support for the guitar between the front sound board and the rear sound board respectively and provide support due to any compromise of support from the presence of the dual bridge By vibrating the common set of strings extending between the two sound boards, sound is transmitted from both the front and rear sound boards of the musical instrument throughout the musical instrument interior to generate a composite of acoustical sound having an intensity and frequency range greater than the intensity and frequency range otherwise generated from an acoustical guitar with the guitar strings connected only to the front sound board. Moreover, sound is further enhanced by coupling each sound board to its own separate sound (pre)amplifier and/or amplifier, which enables the sound produced from each sound board to be independently and separately controlled.

It is also preferred in accordance with the present invention, but not essential, that at least one of the sound boards, preferably the front sound board, include at least one sound port, in addition to the conventional sound hole, through which sound can exit from the guitar independent of the sound hole. The sound port may be located in the general vicinity of the sound hole and should comprise a hollow member of any desired geometry, preferably a tube adapted to be inserted through an opening formed in one of the sound boards, preferably the front sound board, with the hollow member having a length extending from the front sound board to a location within the hollow body of the instrument equal to 5% to 95% of the distance between the front sound board and the rear sound board and forming an opening through the front sound board of any desired size dimension preferably a round in geometry. By varying the extended length of the sound port within the interior of the guitar i.e., selecting a desired length from various different lengths each within the desired range depending on the sound intended the sound port can be tuned to different desired frequency ranges proportional to the resonant frequency of the guitar, e.g. to possess a higher and/or lower frequency spectrum corresponding to a treble or bass sound range different from the frequency spectrum of the sound exiting the sound hole thereby creating a greater dynamic frequency range produced by the musical instrument.

In addition, particularly when a sound port is added to the musical instrument, it is also preferable to include one or a plurality of panels in the body of the musical instrument connected between the front sound board and the rear sound board to funnel sound toward the sound port(s). The panel(s) should be arranged to lie between each sound port and the sound hole, generally but not limited to the upper bout of the guitar and extend preferably up to the neck of the guitar or may interconnect with another panel near the neck of the guitar. In this arrangement, the panels cause sound to be directionally funneled to each sound port and thereby exit the sound port(s) in addition to sound exiting the sound hole. Since the panel(s) are connected between the front and rear sound boards, the panel(s) will inherently provide structural support between the front and rear boards of the guitar serving as an alternative to the current standards and use of ribs on the front and/or rear sound boards in addition to support provided by use of the support posts in the dual bridge and saddle assembly.

SUMMARY OF THE INVENTION

The stringed musical instrument of the present invention comprises a body having a first sound board representing the front surface thereof, a second sound board representing the rear surface thereof, a common hollow or semi-hollow interior extending between the first sound board and the second sound board, and a dual bridge and saddle assembly extending between the first sound board and the second sound board with the dual bridge and saddle assembly comprising a first bridge and saddle mounted upon the first sound board, a second bridge and saddle mounted upon the second sound board and a single set of strings interconnecting the first bridge and the second bridge of the dual bridge and saddle assembly through the common interior of the musical instrument.

The present invention also broadly encompasses a method of constructing a stringed musical instrument, having a body with a hollow or semi-hollow interior, a front and rear sound board disposed on opposite sides of the interior, a single set of strings and a dual bridge and saddle assembly including a first bridge and saddle for the front sound board and a second bridge and saddle for the rear sound board comprising the steps of mounting the first bridge in the dual bridge and saddle assembly upon the front sound board, mounting the second bridge in the dual bridge and saddle assembly upon the rear sound board, and stringing said single set of strings to the musical instrument such that the strings extend between the first bridge and the second bridge through the interior body of the musical instrument for generating sound from each sound board respectively. Preferably, the method further includes structurally connecting the first bridge to the second bridge in the dual bridge and saddle assembly using support posts for providing structural support between the front and rear sound boards respectively.

BRIEF DESCRIPTION OF THE DRAWINGS

Other advantages of the subject invention will become apparent from the following detailed description of the invention when read in conjunction with the accompanying drawings of which.

DETAILED DESCRIPTION OF A PREFERRED EMBODIMENT

All of the drawings are directed to the preferred embodiment of the invention and emphasize selected versions of the present invention without the intent of limiting the scope of the invention.

Figure 1:
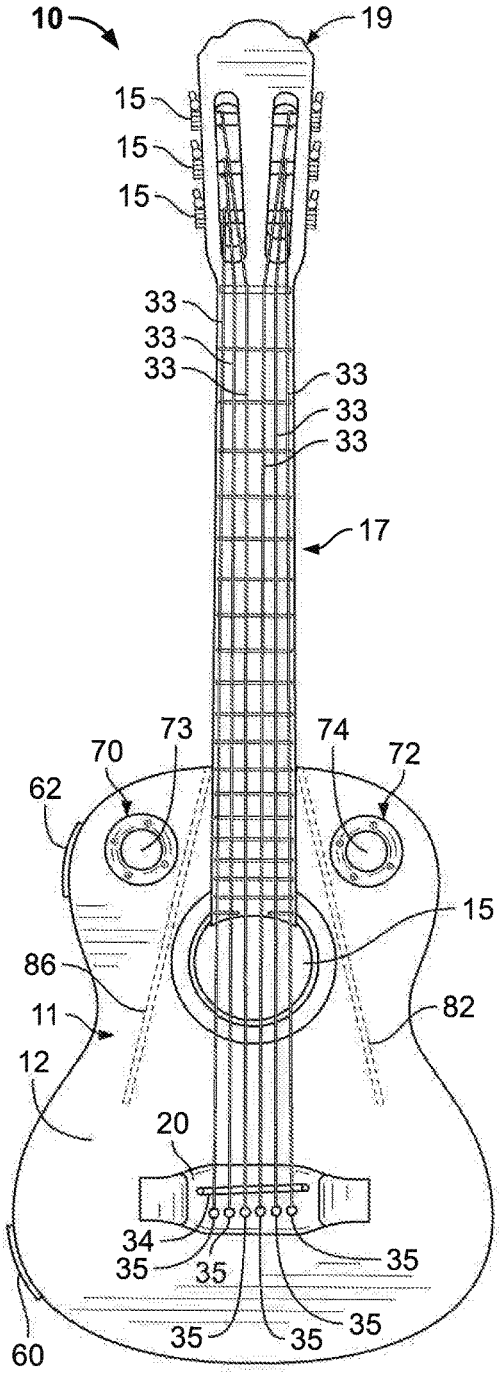
FIG. 1 is an anatomical front view of an acoustical guitar constructed with a dual bridge and saddle assembly in accordance with the present invention.
Figure 2:
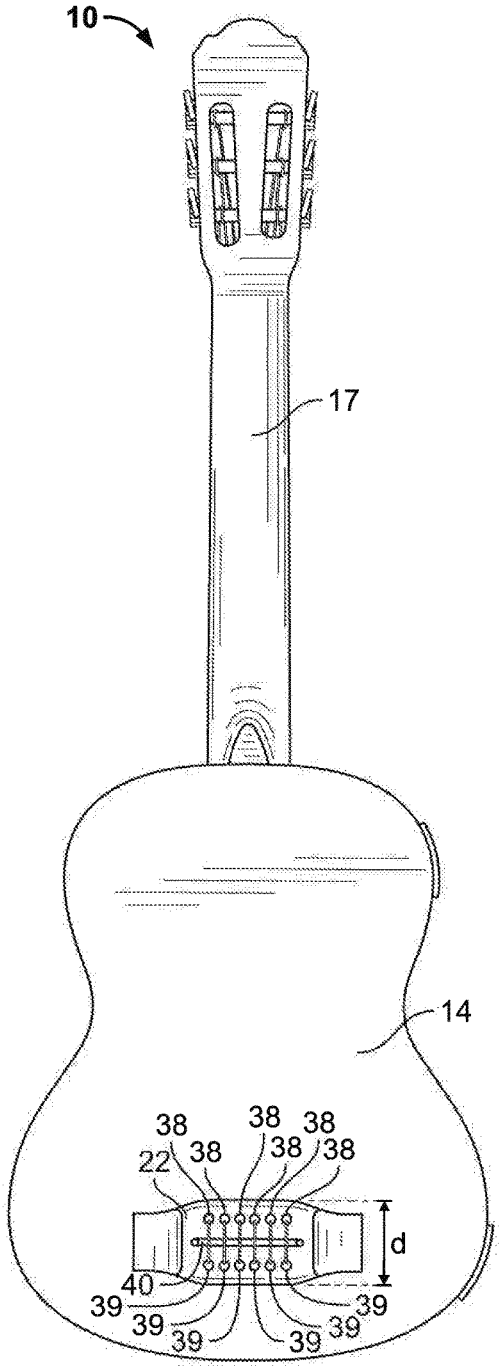
FIG. 2 is an anatomical rear view of the guitar shown in FIG. 1.
Figure 3:
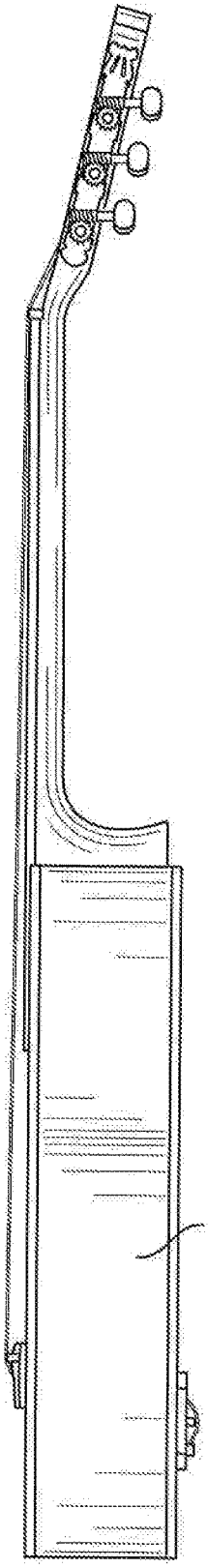
FIG. 3 is an anatomical left side view the guitar of the present invention shown in FIG. 1.
Figure 4:
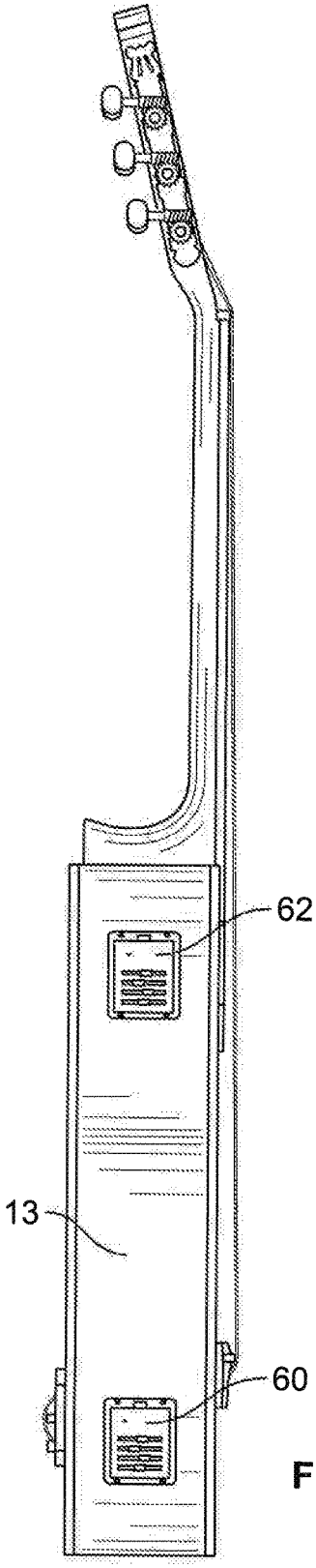
FIG. 4 is an anatomical right side view of the guitar shown in FIG. 1.
Figure 5:
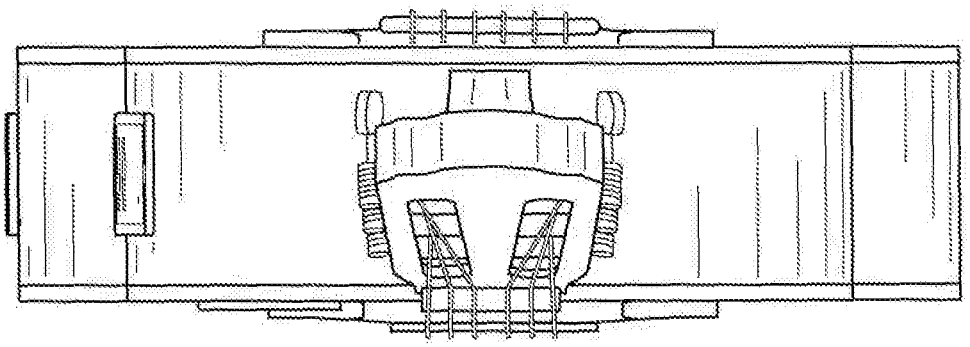
FIG. 5 is an anatomical end view of the guitar shown in FIG. 1 from the headstock top end of the guitar.
Figure 6:
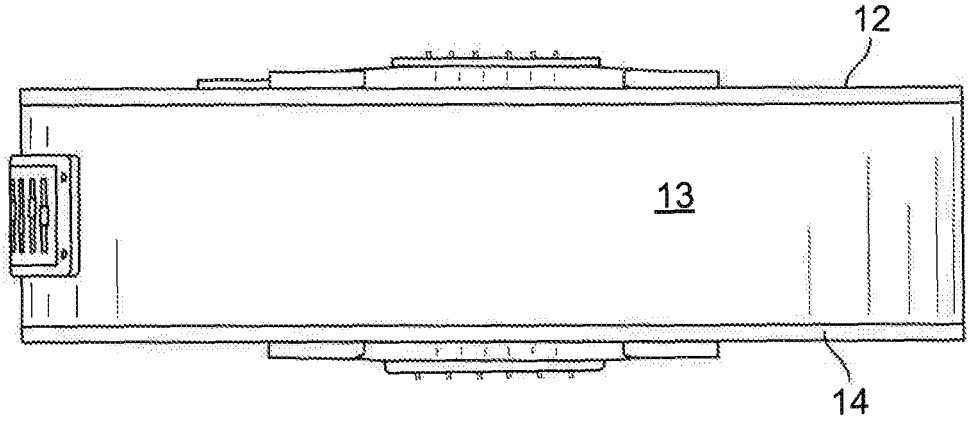
FIG. 6 is an anatomical end view of the guitar shown in FIG. 1 from the lower bout corresponding to the bottom end of the guitar.

The musical instrument of the present invention is illustrated by an acoustical guitar 10 as shown in FIGS. 1-9 inclusive, representing the preferred embodiment thereof. The acoustical guitar 10 comprises a body 11 which includes a front sound board 12 as shown in FIG. 1, a rear sound board 14 as shown in FIG. 2 and a dual bridge and saddle assembly 16 as more specifically shown in FIGS. 8A, 8B, 9A, 9B and 12 respectively, which extends through the hollow or semi-hollow interior 18 of the body 11 from the front sound board 12 to the rear sound board 14 of the guitar 10. The guitar 10 has sides 13, as shown in FIGS. 3, 4 and 6, connecting the front sound board 12 to the rear sound board 14 to fully enclose the body of the guitar 10.

Figure 8A:
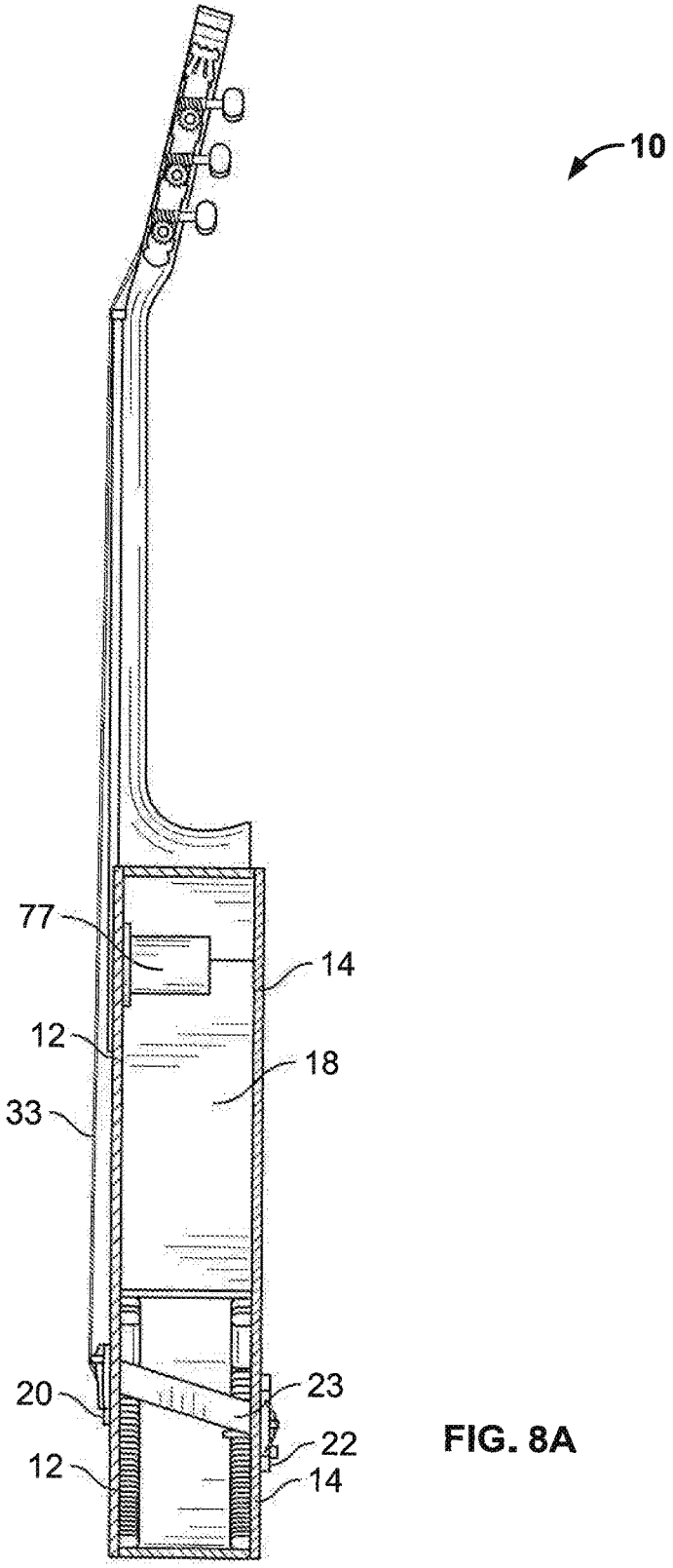
FIG. 8A is an anatomical cross sectional view of the guitar of the present invention taken along the lines 8A-8A shown in FIG. 7.
Figure 8B:
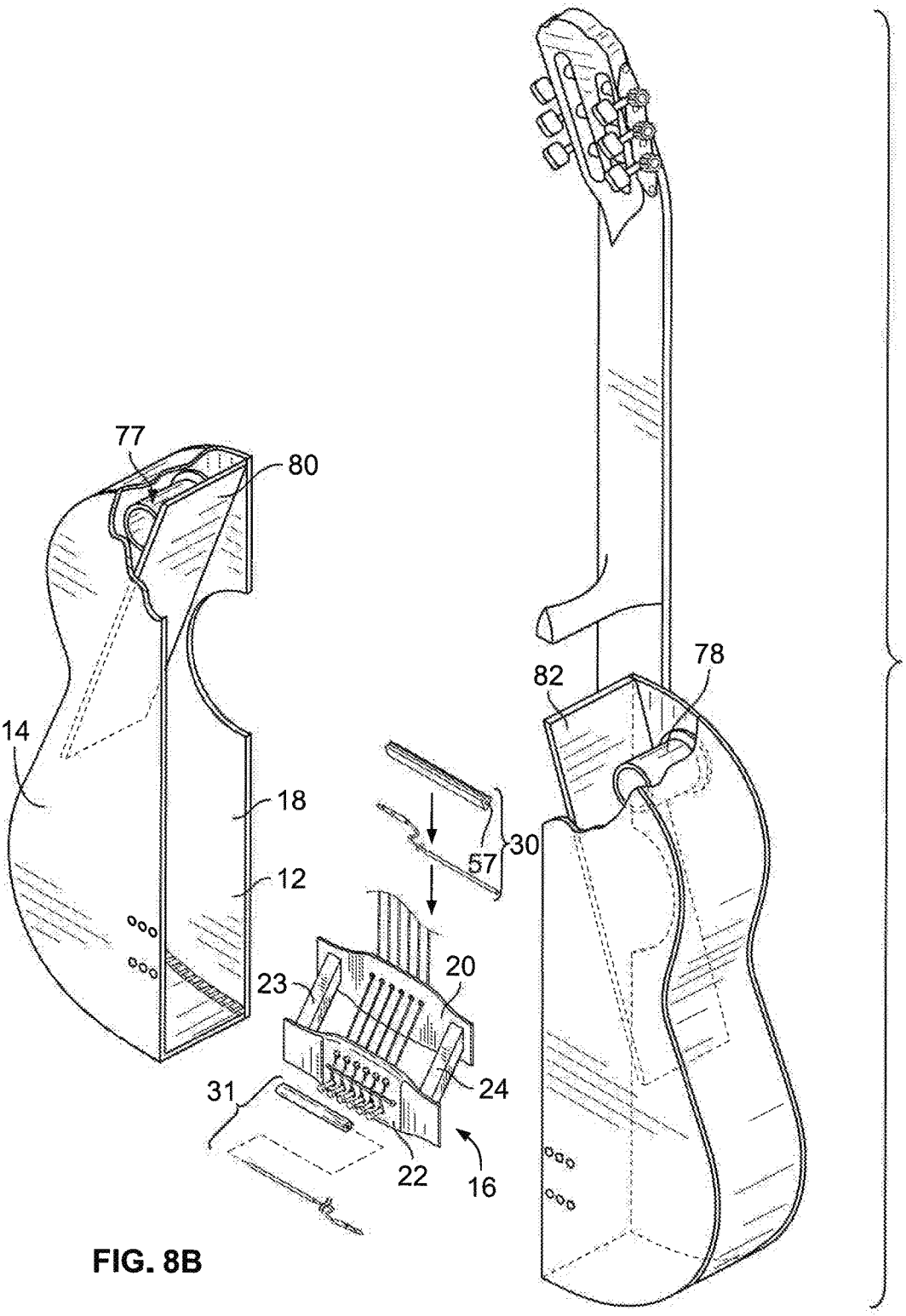
FIG. 8B is an exploded anatomical view in perspective of the guitar shown in FIG. 7 from the rear side thereof, showing the guitar divided into two halves with the dual bridge and saddle assembly shown spaced apart from each half of the guitar and in addition, showing a sound port in each half of the guitar on opposite sides thereof and a straight panel disposed between each sound port and the sound hole in the guitar for funneling or venting sound through each sound port.
Figure 9A:
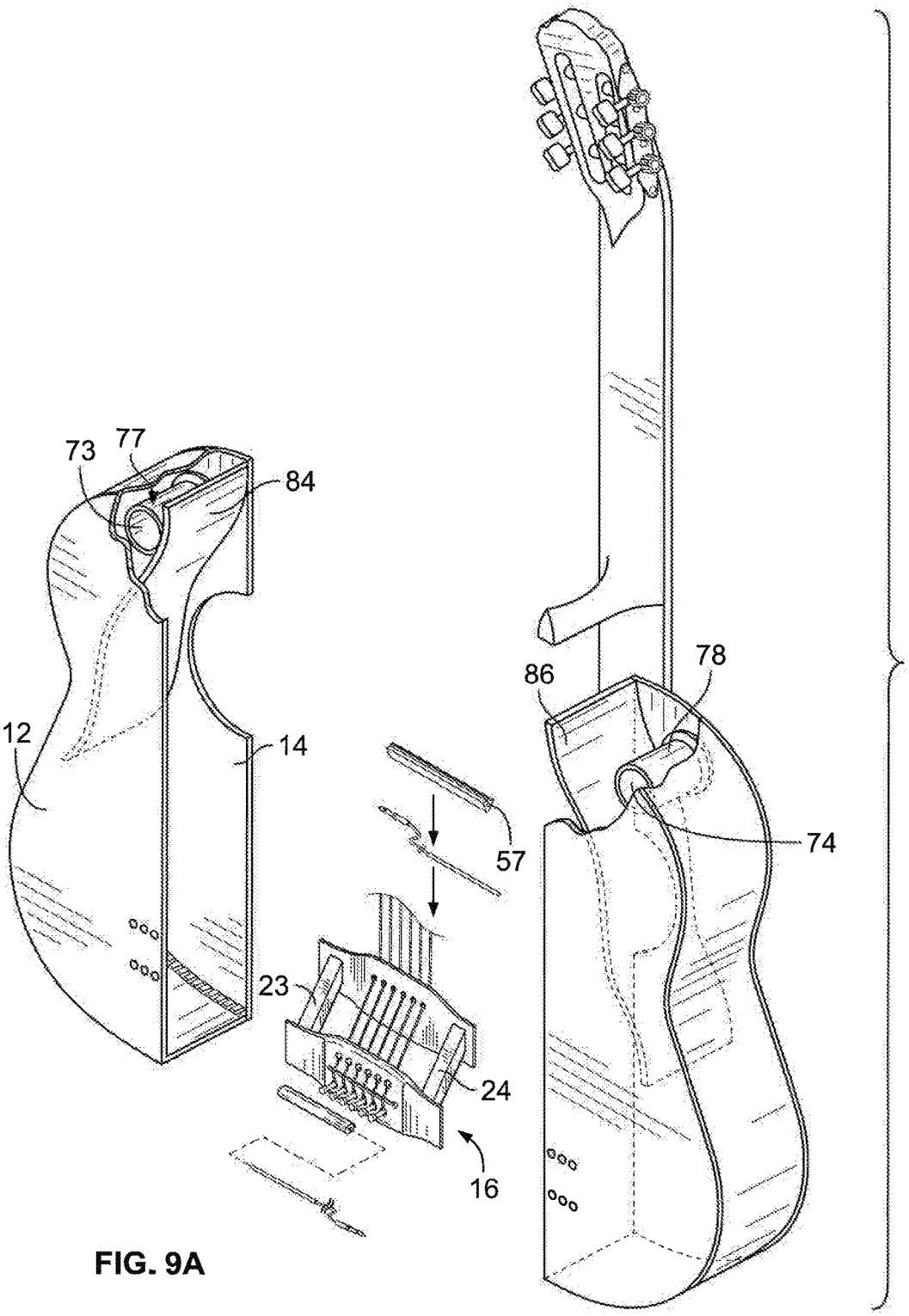
FIG. 9A is another exploded anatomical view of the guitar of the present invention shown in FIG. 8B illustrating an alternate embodiment of the panels of the invention shown in FIG. 8B having an "S" shaped geometry as opposed to being straight.
Figure 9B:
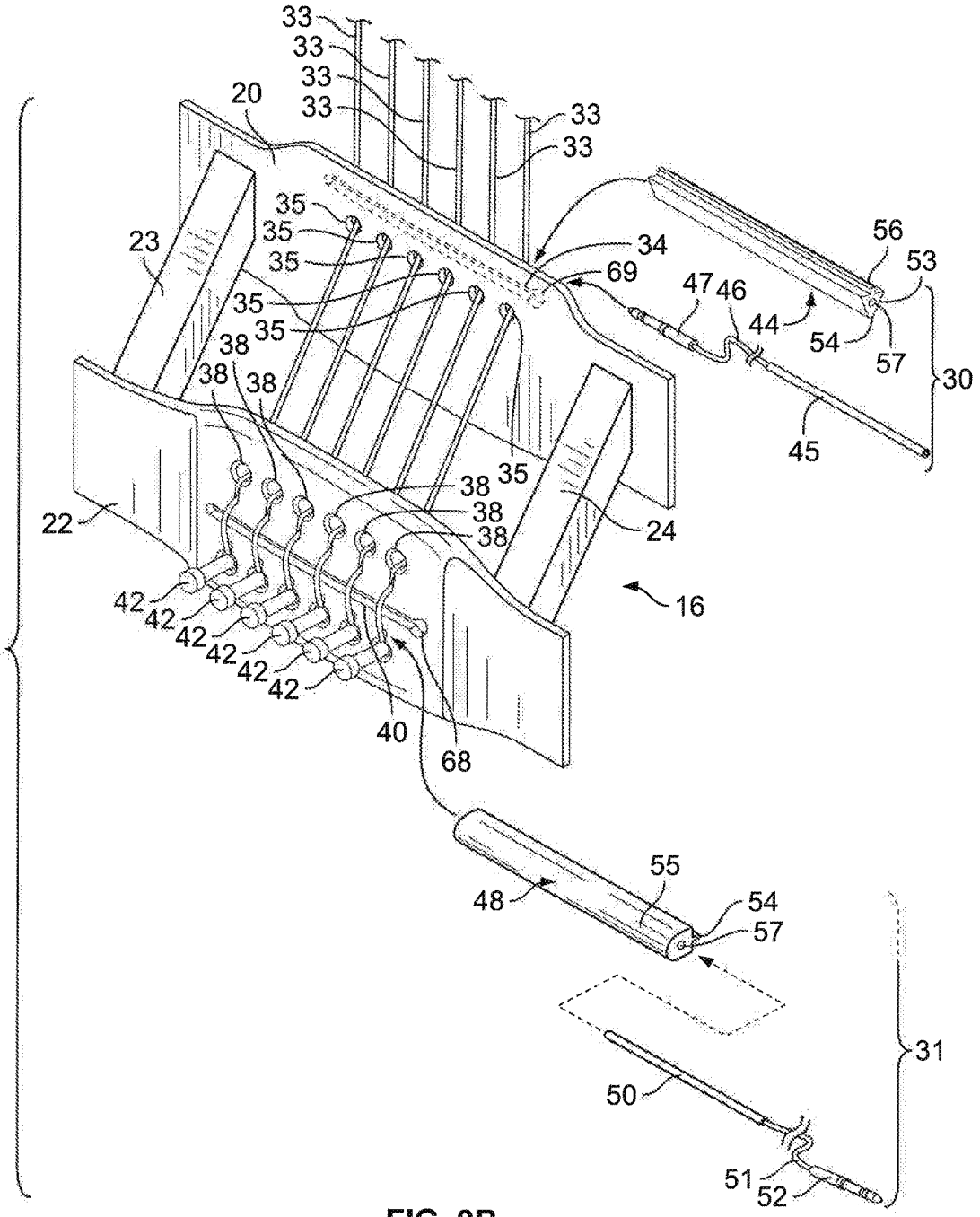
FIG. 9B is an exploded anatomical perspective view of the dual bridge and saddle assembly shown in FIGS. 8B and 9A illustrating the stringing of the set of guitar strings through the interior of the guitar between each bridge in the dual bridge and saddle assembly and further illustrating the arrangement and geometry of the saddle over which the guitar strings are strung for each bridge in the dual bridge and saddle assembly of the present invention.
Figure 10:
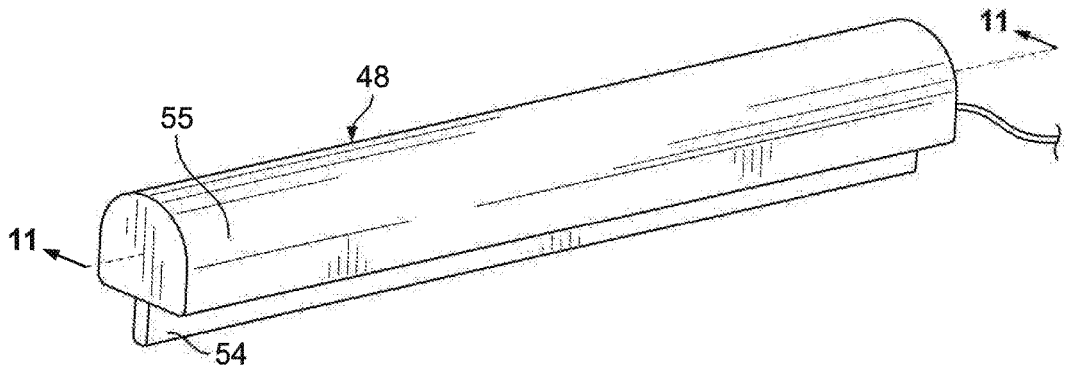
FIG. 10 is a perspective view of a preferred embodiment of one saddle assembly adapted to be mounted in the dual bridge and saddle assembly shown in FIG. 9B and forming a single integrated unit including a saddle and a sound pickup device imbedded in the saddle.
Figure 11:
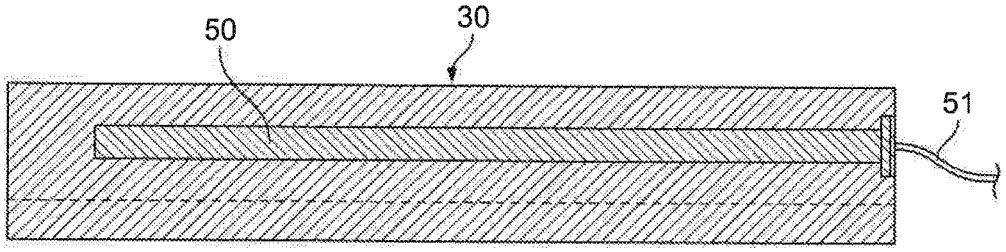
FIG. 11 is a cross sectional view of the integrated saddle and imbedded sound pickup device shown in FIG. 10 taken along the lines 11-11 in FIG. 10.

The dual bridge and saddle assembly 16, shown in FIG. 8A extending between the front and rear sounds boards 12 and 14, comprises a first bridge 20 mounted upon the front sound board 12, a second bridge 22 mounted upon the rear sound board 14, support posts 23 and 24 which interconnect the first bridge 20 to the second bridge 22, a saddle assembly 30, adapted for insertion within a slot 34 in the first bridge 20 as shown in FIG. 9B and a saddle assembly 31 adapted for insertion within a slot 40 the second bridge 22.

A single set of strings 33, of custom or extended length, extend from the headstock 19, which represents the top end of the guitar 10, along the neck 17 of the guitar 10 to the first bridge 20, mounted upon the front sound board 12, and from the first bridge 20 to the second bridge 22, mounted on the rear sound board 14, through the hollow interior 18 within the body 11 of the guitar 10. One end of each string in the set of guitar strings 33 is connected to tuning knobs 15 in the headstock 19 and the opposite end of each string in the set of strings 33 is pegged to the second bridge 22 so that the set of strings 33 interconnect the first bridge 20 to the second bridge 22 through the interior 18 of the guitar 10. The set of strings 33 are preferably strung starting from the pegged location in the second bridge 22 on the rear sound board 14 over a saddle 48 inserted into the second bridge 22 to the first bridge 20 over a saddle 44 into the first bridge 20 from whence the set of strings 33 continue along the neck 17 of the guitar 10 to the tuning knobs 15 as will be further described in connection with FIGS. 9B and 12

The support posts 23 and 24 in the dual bridge and saddle assembly 16 function to support and secure the upper sound board 12 in the guitar 10 to the rear sound board 14 so that neither the front and/or rear sound boards 12 and 14 collapse from too much tension in stringing the guitar strings 33. However, it should be understood that the use of the support posts 23 and 24 is preferred but is not critical to the invention since structural support to prevent collapse of either the front or rear board 12 and 14 relative to one another is obtainable using other support members between the front sound board 12 and the rear sound board 14 independent of the support posts 23 and 24 in the dual bridge and saddle assembly 16 as, for example, will become apparent later in the description in connection with the incorporation of panels 80 and 82 in conjunction with the use of sound ports 70 and 72, respectively. The support posts 23 and 24 in the dual bridge and saddle assembly 16 are preferably disposed at an inclined angle between the front sound board 12 and the rear sound board 14, as is shown in FIG. 8A, with the upper sound board 12 positioned slightly forward toward the neck 17 of the guitar 10 relative to the position of the rear sound board 14. This arrangement relieves some of the tension in the set of guitar strings 33 during tuning of the guitar 10. The support posts 23 and 24 may be constructed of any desired material composition preferably a wood or wood substitute composition and may have any desired geometrical shape including, for example, a square, rectangular, or cylindrical shape.

The first bridge 20, in the dual bridge and saddle assembly 16 as shown in FIGS. 1 and 9B, comprises a slot 34 into which the saddle assembly 30 is inserted and includes a plurality of openings 35 through which the guitar strings 33 are strung with the number of openings 35 corresponding to the number of guitar strings 33 such that for example, if the guitar 10 has six guitar strings 33 the first bridge 20 will have six openings 35. The openings 35 in the first bridge 20 are aligned in a substantially horizontal plane transverse to the direction of the set of guitar strings 33. The slot 34 in the first bridge 20 may preferably lie at an acute angle relative to the horizontal, as is shown in FIG. 1, to facilitate and/or permit adjustment of the specific intonation of the guitar. The first bridge 20 may conform in geometry and dimension to the geometry and dimension of the second bridge 22 in the dual bridge and saddle assembly 16, except for its width dimension. The second bridge 22 should preferably have a width "d", as shown in FIG. 2, which is wider than the width of the first bridge 20 to accommodate two sets of openings 38 and 39 for the guitar strings 33 as opposed to only one set of openings 35 in the first bridge 20. The set of openings 39 in the second bridge 22 are used to secure and peg one end of each of the guitar strings 33 into the openings 39. The two sets of openings 38 and 39 should be arranged in parallel to each other on opposite sides of the slot 40 in the second bridge 22 and should include a total number of openings corresponding to twice the number of string openings 35 present in the first bridge 20.

Figure 12:
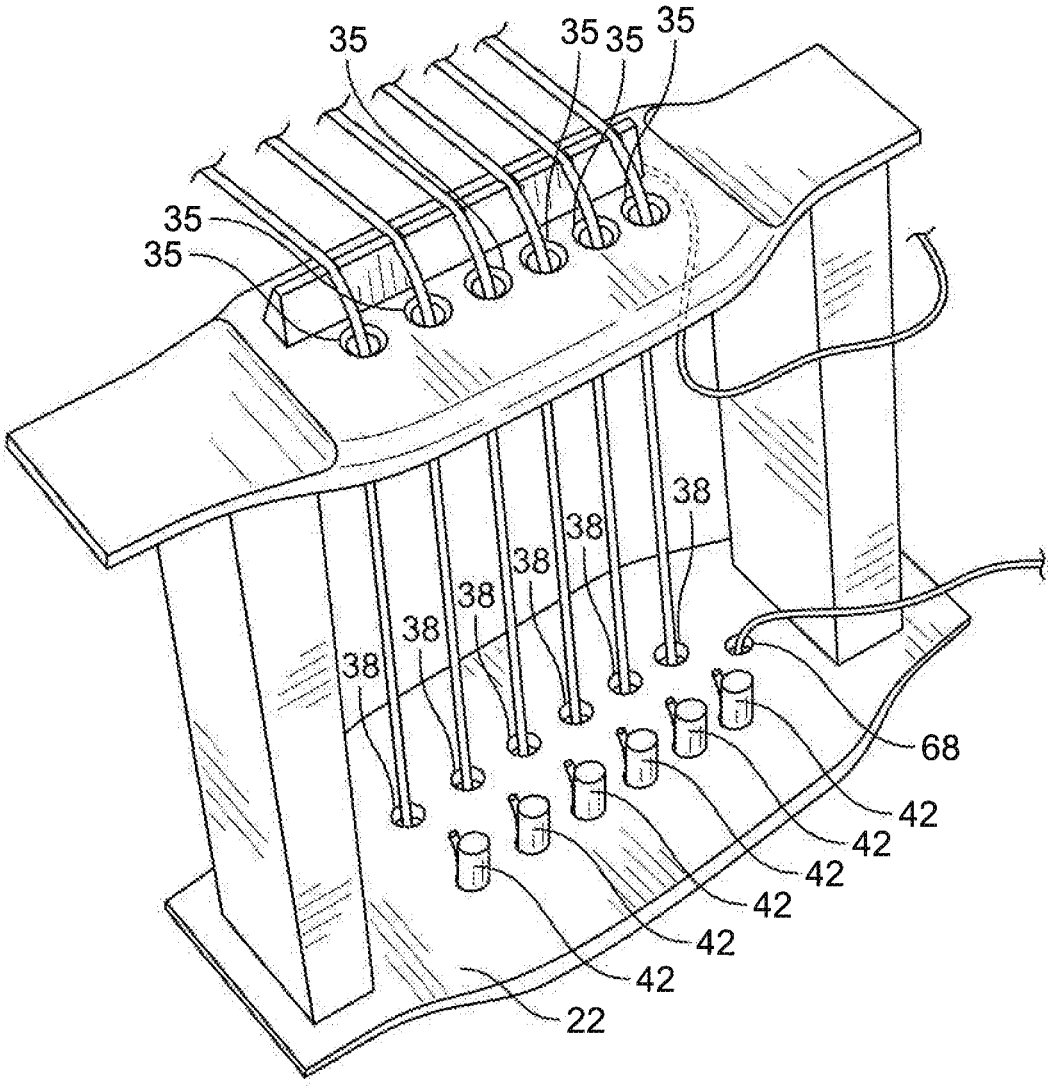
FIG. 12 is another exploded perspective view of the dual bridge and saddle assembly in the guitar of the present invention shown in FIG. 8B illustrating how each string in the set of guitar strings is pegged to the second bridge mounted upon the rear sound board of the guitar and further illustrating how the set of guitar strings are strung to interconnect the second bridge in the rear sound board to the first bridge the front sound board.

The strings 33 are pegged to the openings 39 in the second bridge 22 using peg members 42 as is shown in FIGS. 9B and 12 which are inserted into the openings 39 in engagement with one end of each string 33 so that each peg member 42 engages each string 33 in each of the openings 39 to firmly secure the engaged end of each string into one of the openings 39. The guitar strings 33 are then strung over the saddle 48 in the saddle assembly 31 as shown in FIGS. 9B and 12 from the pegged ends in the openings 39 through the corresponding set of openings 38 in the second bridge 22 and then through the openings 35 in the first bridge 20 from whence they are strung over the saddle 44 in the saddle assembly 30 and along the neck 17 of the guitar 10 to the tuning knobs 15 at the front end 19 of the guitar 10.

Figure 7:
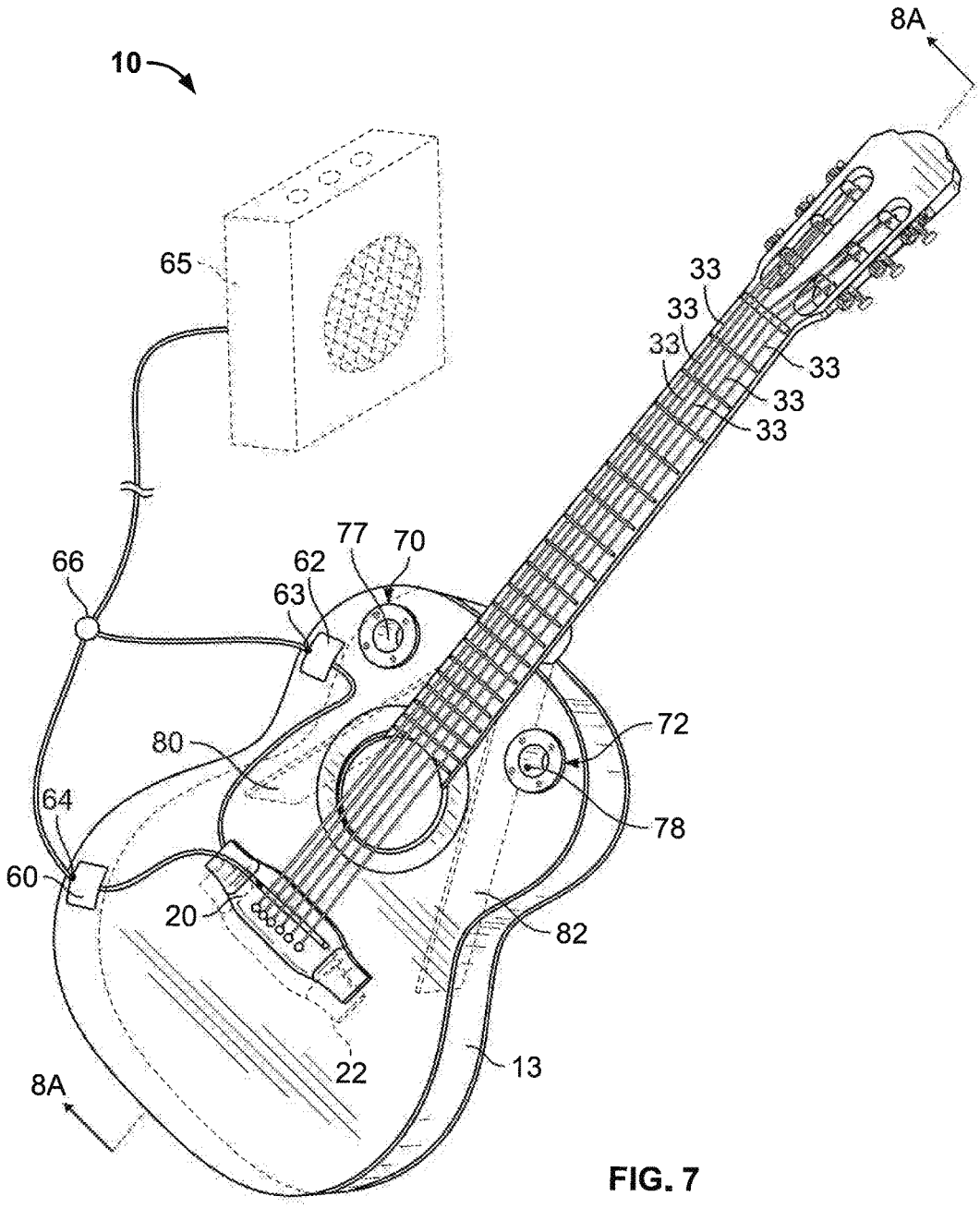
FIG. 7 is an anatomical perspective view of the guitar of the present invention shown in FIG. 1, using dotted lines, for diagrammatically illustrating the placement of a panel between each sound port and the sound hole of the guitar and further illustrating, through use of dotted lines, the two preamps mounted on one side of the guitar and the connection between the sound pickup device mounted in each bridge of the dual bridge and saddle assembly and each preamplifier and the external connection between each of the two preamps and an amplifier.

The saddle assembly 30, which is insertable into the slot 34 in the first bridge 20 of the dual bridge and saddle assembly 16, includes the saddle 44, a pickup device 45, a wire cord 46 and an output jack 47 as shown in FIG. 9B. The pickup device 45 is a conventional component comprising a sound pickup type such as a piezoelectric shielded magnetic device in a coil of wire. The jack 47 extending from the wire cord 46 is adapted for attaching the pickup device 45 to a preamp 60 mounted on a side 13 of the guitar 10 as shown in FIG. 7. Similarly, the saddle assembly 31, which is insertable into the slot 40 in the second bridge 22 of the dual bridge and saddle assembly 16 comprises a saddle 48, a pickup device 50, a wire cord 51 and an outlet jack 52 which extends from the wire cord 51 for attaching the pickup device 50 to a separate preamp 62 which may also be mounted on the same side 13 of the guitar 10. The two preamplifiers 60 and 62 may be connected through outlet jacks 63 and 64 preferably mounted on the side 13 of the guitar 10 to an amplifier 65 as shown in FIG. 7 using, for example, a conventional "Y" connection 66 or alternatively, each preamplifier 60 and 62 may be connected to a separate amplifier (not shown) for controlling sound from each preamplifier respectively.

Each saddle assembly 30 and 31 includes a saddle 44 and 48 and a pickup device 45 and 50 respectively. The saddles 44 and 48 function to support the set of guitar strings 33 over the first and second bridges 20 and 22 on the front and rear sound boards 12 and 14 respectively. Each saddle 44 and 48 may be a component of the saddle assembly 30 and 31 separate and independent of each pickup device 45 and 50 or alternatively one or both of the saddle assemblies 30 and 31 may have the pickup devices 45 and 50 integrated into the saddle assembly 30 and 31 to form a single integrated unit which incorporates both a saddle and pickup in combination. In the guitar of the present invention the pickup device 50 in the saddle assembly 31 is adapted to be inserted into an opening 57 formed in the saddle 48 thereby forming an integrated unit whereas the pickup device 45 in the saddle assembly 30 may or may not be integrated into the saddle 44 to form a single unit. Accordingly, as shown in FIG. 9B, the pickup device 45 in the saddle assembly 30 represents an independent component and, as such, must be separately inserted into the slot 34 in the first bridge 20 followed by insertion of the saddle 44 into slot 34 over the pickup device 45 whereas the saddle 48 combined with the pickup device 50 is inserted as one integrated unit into the slot 40 in the second bridge 22.

Regardless of whether one or both saddle assemblies 30 and 31 is constructed to form a single integrated unit including both a saddle and pickup device, the saddle component 44 and 48 in each of the saddle assemblies 30 and 31 should have a configuration which includes a body portion 53, 55 and a thin section 54 extending outwardly from the body portion 53, 55. The thin extended section 54 should be substantially of rectangular geometry so that each saddle 44 and 48 forms, in cross section, a "T" configuration with the extended thin section 54 representing the vertical side of each "T" configuration and the body portion 53,55 representing the horizontal side. Moreover, the thin section 54 extending from each saddle 44 and 48 should have a width conforming to the width of the slots 34 and 40 in the first and second bridges 20 and 22 respectively, and should have a width substantially thinner than the width of the body portion 53, 55 from which it extends. The body portion 53 of the saddle 44 may have a conical geometry extending to a relatively pointed apex 56 which is adapted to engage the guitar strings 33 in the front sound board 12 whereas the body portion 55 of the saddle 48 may simply have a rounded semi-cylindrical configuration for engaging the guitar strings 33 in the rear sound board 14.

The guitar 10 of the present invention includes at least one sound port 70 although two sound ports 70 and 72 are preferred, as illustrated in FIGS. 1, 7 and 8A, with both sound ports 70 and 72 preferably formed in the front sound board 12 on opposite sides of a sound hole 13 in the guitar 10. The sound hole 13 is located in the body 11 of the guitar 10, preferably in the front sound board 12, at a position underneath the guitar strings 33 and preferably symmetrically between each sound port 70 and 72. Each of the sound ports 70 and 72 should comprise a member 77, 78 of any desired geometry, preferably in the form of a hollow tube which is adapted to be inserted through an opening, formed in one of the sound boards, preferably the front sound board, with the opening shaped to accommodate members 77, 78. Each member 77, 78 should have a length so that the members 77,78 extend from the front sound board 12 of the guitar 10 to a location within the hollow interior 18 of the guitar 10 equal to between 5% and 95% of the distance between the front sound board 12 and the rear sound board 14 and should have an opening 73, 74 extending through each member 77, 78 of any desired geometry and size preferably round so that each member 77, 78 preferably forming a parabolic or cylindrical geometry, By varying either or both the size of the opening 73, 74 and the extended length of each sound port 70 and 72 within the interior 18 of the guitar 10 the sound ports 70, 72 can be separately tuned to any desired frequency range proportional to the resonant frequency of the guitar. The optimal condition is for the sound ports 70 and 72 to have round openings 73,74 of equal size in each member 77, 78, with the length of each member 77, 78 corresponding to between 20% and 80% of the distance from the front sound board 12 to the rear sound board 14 to enhance the tuning of most acoustical guitars. However the length and size dimensions of each member 77 and 78 of each sound port 70 and 72 need not be identical.

Each sound port 70 and 72 should preferably be accompanied by a panel 80 and 82 which is a geometrically straight panel connected between the front sound board 12 and the rear sound board 14 in an arrangement lying between each sound port 70 and 72 and the sound hole 13 and extending from a position relatively near the lower bout of the guitar 10 to a position adjacent the neck 17 of the guitar 10 or alternatively so that each straight panel 80 and 82 intersects one another near the neck 17 of the guitar 10. This will permit sound to be funneled or vented toward the sound ports 70 and 72. Although only two panels 80 and 82 are shown additional straight panels may be used to form a sound labyrinth within the interior 18 of the guitar body 11.

An alternative to the use of straight panels 80 and 82 is shown in FIG. 9A with each panel having a serpentine curvature in the form of an 'S" connected between the front sound board 12 and the rear soundboard 14.

As explained previously, since the panels 80 and 82 are connected between the front sound board 12 and the rear soundboard 14 the panels 80 and 82, in conjunction with or without the use of support posts 23 and 24, will act as structural supports for preventing the front and/or rear sound board from collapsing when the string tension is too high

What is claimed is:

1. A stringed musical instrument comprising a body having a first sound board representing the front surface thereof, a second sound board representing the rear surface thereof, a common hollow or semi-hollow interior extending between the first sound board and the second sound board, and a dual bridge and saddle assembly extending between the first sound board and the second sound board with the dual bridge and saddle assembly comprising a first bridge and saddle mounted upon the first sound board, a second bridge and saddle mounted upon the second sound board and a single set of strings interconnecting the first bridge and the second bridge of the dual bridge and saddle assembly through the hollow interior of the musical instrument.

2. A stringed musical instrument as claimed in claim 1 wherein the dual bridge and saddle assembly further comprises support posts connecting the front board to the rear sound board through the hollow interior of the musical instrument.

3. A stringed musical instrument as claimed in claim 2 wherein the support posts are of any geometry selected from the group consisting of a solid cylindrical geometry, a solid rectangular geometry or a solid square shaped geometry.

4. A stringed musical instrument as claimed in claim 2 wherein the first bridge comprises a plurality of holes aligned transverse to the direction of the set of strings through which the set of strings are strung with the second bridge comprising two set of holes totaling twice the number of holes present in the first bridge with-the single set of strings pegged within one of the two sets of holes in the second bridge.

5. A stringed musical instrument as claimed in claim 4 further comprising a plurality of peg members adapted to be inserted into one of the two sets of holes in the second bridge for pegging each string in the set of strings to the second bridge.

6. A stringed musical instrument as claimed in claim 1 further comprising a first saddle assembly adapted to be connected to the first bridge, a second saddle assembly adapted to be connected to the second bridge with each saddle assembly comprising a saddle, a conventional sound pickup type device and a wire cord and an output jack for connecting the sound pickup type device in the first and second saddle assembly to separate preamplifiers mounted in the musical instrument.

7. A stringed musical instrument as claimed in claim 6 wherein said first and second bridge include a slot for receiving the saddle from each said saddle assembly.

8. A stringed musical instrument as claimed in claim 7 wherein each saddle in both said first and second saddle assembly comprises a body portion and a thin section extending outwardly from the body portion having a substantially rectangular configuration with a width in substantial conformity to the width of the slot in each bridge so that the saddle fits tightly within the slot of the first and second bridge in the dual bridge and saddle assembly.

9. A stringed musical instrument as claimed in claim 8 wherein at least one of said first and second saddle assemblies is an integrated unit in which the sound type pickup device is incorporated within the body portion of the saddle assembly.

10. A stringed musical instrument as claimed in claim 9 wherein the body portion of each of said first saddle and second saddle assembly is of a geometrical configuration selected from the group consisting of a conical geometry having an apex for engaging the set of strings and a semi-cylindrical geometry with the semi-cylindrical geometry having a rounded surface to engage the set of strings.

11. A stringed musical instrument as claimed in claim 1 wherein the musical instrument further comprises a sound hole through which sound can exit and at least one sound port separate from the sound hole with the sound port comprising a member adapted to be inserted through a hole formed in either said front sound board or said rear sound board with the member having a central opening of predetermined size dimension and length such that said member extends a fixed distance into the interior of the musical instrument equal to between 5% and 95% of the distance between the front sound board and the rear sound board.

12. A stringed musical instrument as claimed in claim 11 wherein the member in said sound port comprises a tube having a round central opening and a length which extends a fixed distance into the interior of the musical instrument equal to between 5% and 95% of the distance between the front sound board and the rear sound board.

13. A stringed musical instrument as claimed in claim 11 wherein the musical instrument further comprises at least one sound port formed in either the front sound board or rear sound board at a location adjacent the sound hole.

14. A stringed musical instrument as claimed in claim 13 further comprising at least one panel connected between the front sound board and the rear sound board in an arrangement extending between the sound port and sound hole to directionally funnel sound toward the sound port.

15. A stringed musical instrument as claimed in claim 14 further comprising a plurality of panels wherein each panel is a straight panel connecting the front sound board to the rear sound board and extending from a position relatively near a bridge on the front or rear sound board to a position near the neck of the musical instrument and located between each sound port and sound hole.

16. A stringed musical instrument as claimed in claim 15 wherein each panel is a curved panel connecting the front sound board to the rear sound board and having a serpentine geometry in an "S" configuration.

17. A stringed musical instrument as claimed in claim 10 wherein each preamplifier is connected in common to a single amplifier or is connected to separate amplifiers.

18. A method of constructing a stringed musical instrument, having a body with a hollow or semi-hollow interior, a front and rear sound board disposed on opposite sides of the hollow interior, a single set of strings and a dual bridge and saddle assembly including a first bridge mounted upon the front sound board and a second bridge mounted upon the rear sound board with the method comprising the steps of mounting a first saddle assembly in the first bridge of the dual bridge and saddle assembly, mounting a second saddle assembly in the second bridge of the dual bridge and saddle assembly, and stringing said single set of strings to the musical instrument between the first saddle assembly and the second saddle assembly such that the strings interconnect the first bridge and the second bridge through the hollow interior body of the musical instrument for generating sound from each sound board respectively.

19. A method of constructing a stringed musical instrument as defined in claim 18 further comprising support posts interconnecting the first bridge to the second bridge of said dual bridge and saddle assembly through the hollow interior for structurally supporting the front sound board to the rear sound board.

20. A method of constructing a stringed musical instrument as defined in claim 18 having a sound hole and at least one sound port located adjacent the sound hole having a hollow member extending through either the front sound board or the rear sound board with the length of the hollow member selected to extend a fixed distance into the interior of the musical instrument equal to between 5% and 95% of the distance between the front sound board and the rear sound board for tuning the sound port to a desired frequency range proportional to the resonant frequency of the guitar.

21. A method of constructing a stringed musical instrument as defined in claim 20 wherein the length of the hollow member is selected to extend a fixed distance into the interior of the musical instrument equal to between 20% and 80% of the distance between the front sound board and the rear sound board for tuning the sound port to a desired frequency range proportional to the resonant frequency of the guitar.

22. A method of constructing a stringed musical instrument as defined in claim 21 further comprising placing a panel between the sound port and sound hole for funneling or venting sound through the sound port.

23. A method of constructing a stringed musical instrument as defined in claim 22 wherein the panel is a straight panel or a curved panel having a serpentine curvature.

* * * * *